US012180970B2

(12) United States Patent
Nose et al.

(10) Patent No.: US 12,180,970 B2
(45) Date of Patent: Dec. 31, 2024

(54) COMPRESSOR

(71) Applicant: DAIKIN INDUSTRIES, LTD., Osaka (JP)

(72) Inventors: Taiichi Nose, Osaka (JP); Hirofumi Higashi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/374,328

(22) Filed: Sep. 28, 2023

(65) Prior Publication Data

US 2024/0026886 A1 Jan. 25, 2024

Related U.S. Application Data

(63) Continuation of application No. PCT/JP2022/004317, filed on Feb. 3, 2022.

(30) Foreign Application Priority Data

Mar. 30, 2021 (JP) ..... 2021-056637

(51) Int. Cl.
*F04D 17/12* (2006.01)
*F04D 29/42* (2006.01)
*F25B 31/02* (2006.01)

(52) U.S. Cl.
CPC ..... *F04D 17/12* (2013.01); *F04D 29/4213* (2013.01); *F25B 31/026* (2013.01)

(58) Field of Classification Search
CPC ..... F25B 1/10; F04D 17/12; F04D 17/122
See application file for complete search history.

(56) References Cited

U.S. PATENT DOCUMENTS 1,900,531 A * 3/1933 Vitu ..... F04D 1/06 415/100
2,286,522 A * 6/1942 Watson ..... F04D 17/12 415/100
3,390,545 A 7/1968 Hoffman

FOREIGN PATENT DOCUMENTS

JP 55-90799 U 6/1980
JP 2002-327700 A 11/2002
(Continued)

OTHER PUBLICATIONS

International Search Report of corresponding PCT Application No. PCT/JP2022/004317 dated Mar. 8, 2022.
(Continued)

*Primary Examiner* — Justin D Seabe
(74) *Attorney, Agent, or Firm* — Global IP Counselors, LLP

(57) ABSTRACT

A compressor includes a first-stage compression unit configured to compress a refrigerant, a second-stage compression unit configured to compress the refrigerant compressed by the first-stage compression unit, a shaft member connected to the first-stage compression unit and the second-stage compression unit, and a cover member configured to cover the shaft member. A first passage is provided between the first-stage compression unit and the second-stage compression unit. A front chamber is provided around the cover member. The front chamber is connected to the first passage and to a second passage to which the refrigerant from an economizer is sent. The second passage is provided with a passage structure configured such that a flowing direction of the refrigerant supplied through the second passage to the front chamber is an avoidance direction. The avoidance direction is a direction that differs from a direction toward the shaft member.

11 Claims, 8 Drawing Sheets

(56) References Cited

FOREIGN PATENT DOCUMENTS

| | | | |
|---|---|---|---|
| JP | 2014-137008 | A | 7/2014 |
| JP | 2020-159643 | A | 10/2020 |

OTHER PUBLICATIONS

International Preliminary Report of corresponding PCT Application No. PCT/JP2022/004317 dated Oct. 12, 2023.
European Search Report of corresponding EP Application No. 22 77 9509.3 dated Jun. 27, 2024.

* cited by examiner

COMPRESSOR

CROSS-REFERENCE TO RELATED APPLICATIONS

This is a continuation of International Application No. PCT/JP2022/004317 filed on Feb. 3, 2022, which claims priority to Japanese Patent Application No. 2021-056637, filed on Mar. 30, 2021. The entire disclosures of these applications are incorporated by reference herein.

BACKGROUND

Technical Field

The present disclosure relates to a compressor.

Background Art

Japanese Unexamined Patent Application Publication No. 2020-159643 describes a centrifugal two-stage compressor. Such a multistage compressor includes a first-stage compression unit and a second-stage compression unit, and a refrigerant compressed by the first-stage compression unit is compressed by the second-stage compression unit and discharged. Between the first-stage compression unit and the second-stage compression unit, a refrigerant from an economizer is mixed with the refrigerant that is sent from the first-stage compression unit to the second-stage compression unit.

As such a compressor, there are a compressor of a type in which an intermediate pipe for sending a refrigerant compressed by a first-stage compression unit to a second-stage compression unit is provided between the first-stage compression unit and the second-stage compression unit, and a compressor of a type in which the intermediate pipe is not provided from the point of view of, for example, making the compressor compact. In the compressor in which the intermediate pipe is provided, a refrigerant from an economizer is mixed, in the intermediate pipe, with the refrigerant sent from the first-stage compression unit to the second-stage compression unit. In this case, since the distance of a flow path of the refrigerant between the first-stage compression unit and the second-stage compression unit is ensured to some extent by the intermediate pipe, it is possible to suppress generation of imbalance in the refrigerant from the economizer when the refrigerant from the economizer is mixed with the refrigerant sent from the first-stage compression unit to the second-stage compression unit.

SUMMARY

A first aspect of the present disclosure is directed to a compressor including a first-stage compression unit configured to compress a refrigerant, a second-stage compression unit configured to compress the refrigerant compressed by the first-stage compression unit, a shaft member connected to the first-stage compression unit and the second-stage compression unit, and a cover member configured to cover the shaft member. A first passage is provided between the first-stage compression unit and the second-stage compression unit. A front chamber is provided around the cover member. The front chamber is connected to the first passage and to a second passage to which the refrigerant from an economizer is sent. The second passage is provided with a passage structure configured such that a flowing direction of the refrigerant supplied through the second passage to the front chamber is an avoidance direction. The avoidance direction is a direction that differs from a direction toward the shaft member.

DETAILED DESCRIPTION OF EMBODIMENT(S)

Figure 1:
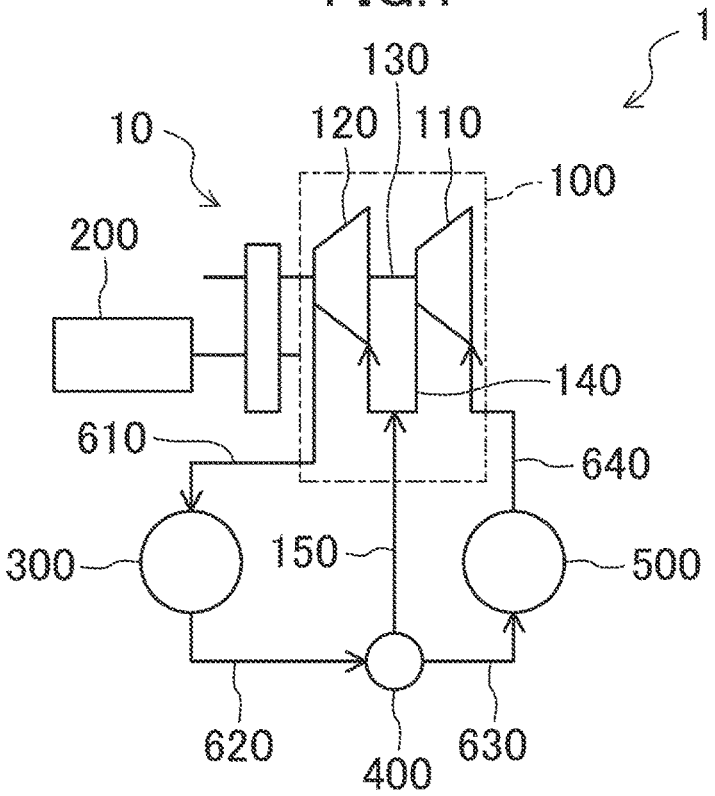
FIG. 1 is a block diagram illustrating a configuration of a refrigeration cycle apparatus according to a first embodiment of the present invention.

An embodiment of the present invention will be described with reference to the drawings. Components identical or corresponding to each other are given identical reference signs in the drawings, and detailed description of the components and description of effects and the like associated therewith are not repeated.

Figure 2:
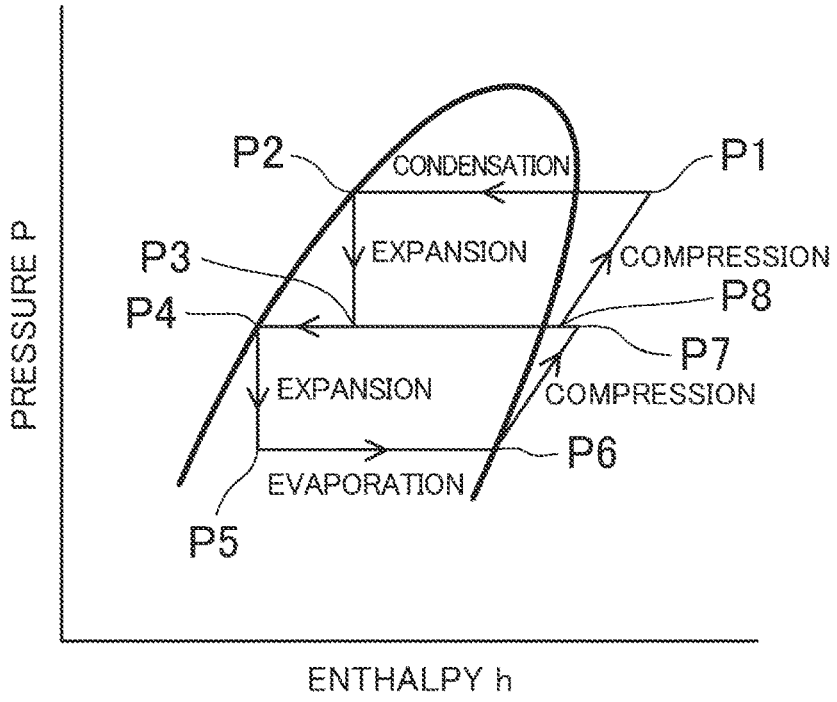
FIG. 2 is an illustration of an operation of a refrigeration cycle.
Figure 3:
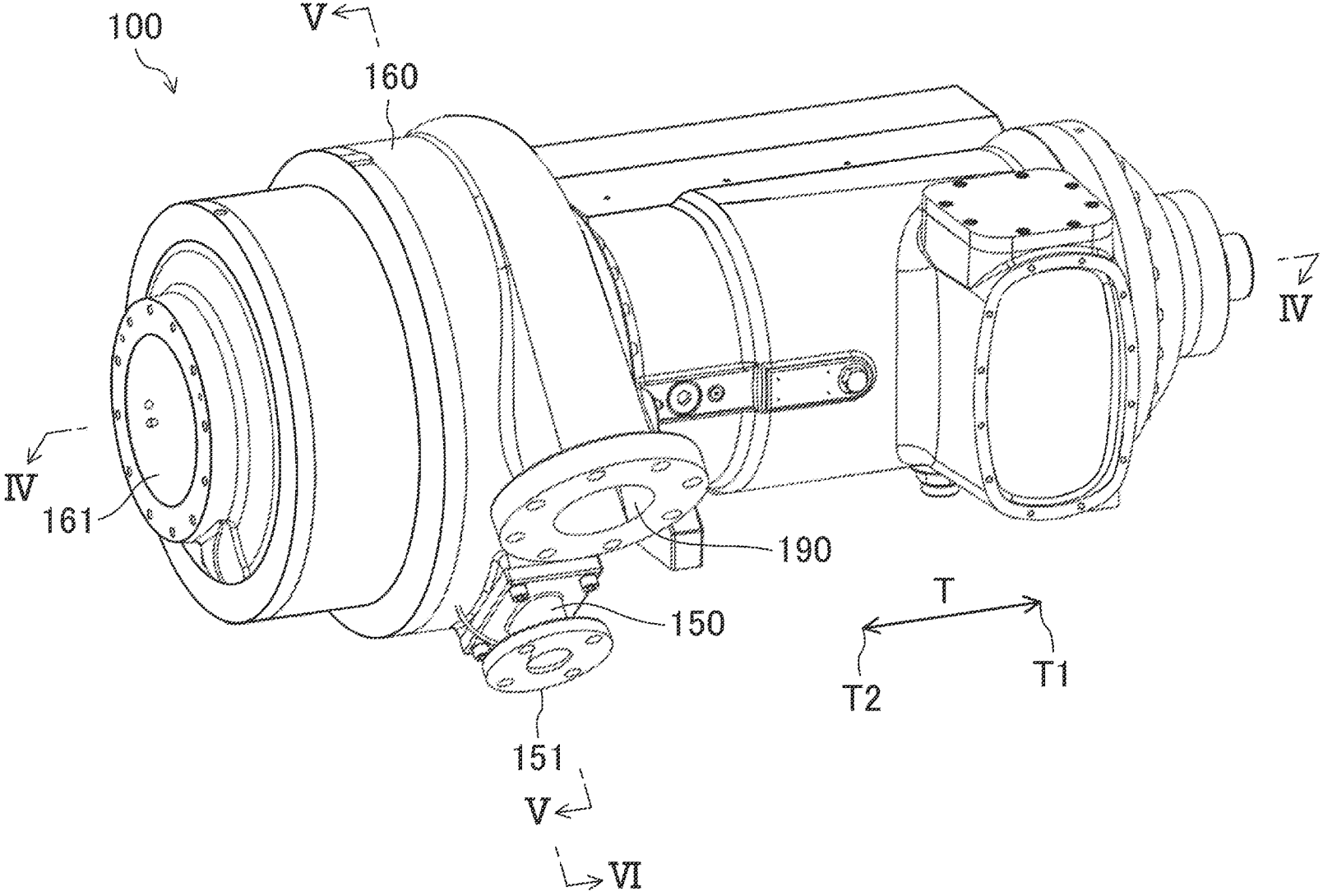
FIG. 3 is a perspective view of a compressor.

With reference to FIG. 1 to FIG. 3, a refrigeration cycle apparatus (1) according to an embodiment of the present invention will be described. FIG. 1 is a block diagram illustrating a configuration of the refrigeration cycle apparatus (1).

Overall Configuration

As illustrated in FIG. 1, the refrigeration cycle apparatus (1) includes a compressor (10), a condenser (300), an economizer (400), an evaporator (500), and a first pipe (610) to a fourth pipe (640).

The compressor (10) is, for example, a centrifugal two-stage compressor. The compressor (10) includes a compression unit (100) and an electric motor (200). The compression unit (100) includes a first-stage compression unit (110), a second-stage compression unit (120), a shaft member (130), a tubular first passage (140), and a tubular second passage (150).

The first-stage compression unit (110) compresses a refrigerant that has exchanged heat in the condenser (300). As the refrigerant, for example, R134a (hydrofluorocarbon), which is a chlorofluorocarbon substitute, or the like is used. The second-stage compression unit (120) compresses the refrigerant compressed by the first-stage compression unit (110). The shaft member (130) is connected to the electric motor (200) and receives the power of the electric motor (200). The shaft member (130) is connected to the first-stage compression unit (110) and the second-stage compression unit (120), and transmits the power of the electric motor (200) to the first-stage compression unit (110) and the second-stage compression unit (120). The power of the electric motor (200) drives the first-stage compression unit (110) and the second-stage compression unit (120), and the refrigerant is thereby compressed. The first passage (140) is connected to the first-stage compression unit (110) and the second-stage compression unit (120), and the refrigerant compressed by the first-stage compression unit (110) is sent through the first passage (140) to the second-stage compression unit (120).

The first pipe (610) is connected to the compression unit (100) and the condenser (300), and the refrigerant compressed by the compression unit (100) (the second-stage compression unit (120)) is sent through the first pipe (610) to the condenser (300). The condenser (300) condenses the refrigerant. The condenser (300) causes the refrigerant to exchange heat with cooling water or the like, thereby cooling the refrigerant into a liquid state. The condenser (300) is, for example, a shell-and-tube heat exchanger.

The second pipe (620) is connected to the condenser (300) and the economizer (400), and the refrigerant condensed by the condenser (300) is sent through the second pipe (620) to the economizer (400). The economizer (400) separates the refrigerant into a gas-phase refrigerant and a liquid-phase refrigerant.

The second passage (150) (economizer nozzle) is connected to the economizer (400) and the compression unit (100), and the gas-phase refrigerant separated by the economizer (400) is sent through the second passage (150) to the compression unit (100). The third pipe (630) is connected to the economizer (400) and the evaporator (500), and the liquid-phase refrigerant separated by the economizer (400) is sent through the third pipe (630) to the evaporator (500). The evaporator (500) causes the refrigerant to exchange heat with water and evaporate into a saturated vapor state. The fourth pipe (640) is connected to the evaporator (500) and the compression unit (100), and the refrigerant that has exchanged heat in the evaporator (500) is sent through the fourth pipe (640) to the compression unit (100) (the first-stage compression unit (110)).

With reference to FIG. 1 and FIG. 2, an operation of the refrigeration cycle of the refrigeration cycle apparatus (1) will be described. FIG. 2 is an illustration of an operation of the refrigeration cycle.

As illustrated in FIG. 1 and FIG. 2, the refrigerant (P6) sucked into the compression unit (100) is compressed (P7) by the first-stage compression unit (110) of the compression unit (100), and the compressed refrigerant merges (P8) with the refrigerant that has flowed from the economizer (400) through the second passage (150) and is then discharged from the compression unit (100) after further compressed by the second-stage compression unit (120).

The refrigerant (P1) having a high temperature and a high pressure and discharged from the compression unit (100) flows into the condenser (300). The refrigerant that has flowed into the condenser (300) is condensed by exchanging heat with water and flows out from the condenser (300).

The refrigerant (P2) that has a high temperature and a high pressure and that has flowed out from the condenser (300) is expanded and decompressed (P3) to become a gas-liquid two-phase refrigerant and flows into the economizer (400). The gas-liquid two-phase refrigerant that has flowed into the economizer (400) is separated into a gas-phase refrigerant and a liquid-phase refrigerant by the economizer (400). The gas-phase refrigerant having a higher enthalpy than the liquid-phase refrigerant flows toward the compression unit (100) through the second passage (150) and, in the first passage (140), merges (P8) with the refrigerant compressed by the first-stage compression unit (110). The merged refrigerant is compressed by the second-stage compression unit (120) and discharged (P1) from the compression unit (100).

The liquid-phase refrigerant (P4) having a lower enthalpy is expanded and decompressed (P5) to become a gas-liquid two-phase refrigerant and flows into the evaporator (500). The gas-liquid two-phase refrigerant that has flowed into the evaporator (500) is evaporated by exchanging heat with water and flows out as a gas-phase refrigerant from the evaporator (500). The refrigerant (P6) that has flowed out from the evaporator (500) is sucked into the compression unit (100) again and compressed (P7) by the first-stage compression unit (110).

Compression Unit

With reference to FIG. 3 to FIG. 7, the compression unit (100) will be described.

As illustrated in FIG. 3 to FIG. 7, the compression unit (100) in the present embodiment employs a two-stage in-line structure, in which the dimension of the compression unit (100) in an axial direction (T) of the shaft member (130) is configured to be compact by disposing the first-stage compression unit (110) and the second-stage compression unit (120) to be close to each other without providing an intermediate pipe between the first-stage compression unit (110) and the second-stage compression unit (120).

The compression unit (100) includes a casing (160), a partition member (170), a front chamber (180), and a third passage (190).

The casing (160) houses the first-stage compression unit (110), the second-stage compression unit (120), the shaft member (130), the first passage (140), the front chamber (180), and a cover member (171). The casing (160) has an inflow port (161). The inflow port (161) is connected to the fourth pipe (640) (refer to FIG. 1). The refrigerant from the fourth pipe (640) flows into the inflow port (161). The refrigerant that has flowed into the inflow port (161) is sent to the first-stage compression unit (110) and is then sent to the second-stage compression unit (120) through the first passage (140).

The first-stage compression unit (110) and the second-stage compression unit (120) are disposed to be spaced apart from each other in the axial direction (T) of the shaft member (130). The second-stage compression unit (120) is disposed on one direction side (T1) in the axial direction (T) with respect to the first-stage compression unit (110).

A first impeller (111) of the first-stage compression unit (110), a second impeller (121) of the second-stage compression unit (120), and the electric motor (200) are connected to the shaft member (130). In response to the shaft member (130) being rotated by the power of the electric motor (200), the first impeller (111) and the second impeller (121) rotate. As a result, the refrigerant that passes through the first impeller (111) is compressed by a centrifugal force, and the refrigerant that passes through the second impeller (121) is compressed by a centrifugal force.

The partition member (170) partitions the inside of the casing (160) so as to form the front chamber (180) inside the casing (160). The partition member (170) includes the cover member (171). The cover member (171) has a shape that covers the shaft member (130). The cover member (171) has a cylindrical shape, and the shaft member (130) is inserted into the cover member (171). The first passage (140) is present between the cover member (171) and the shaft member (130).

The front chamber (180) is a space to which the refrigerant from the economizer (400) (refer to FIG. 1) is supplied. The front chamber (180) is disposed between the first-stage compression unit (110) and the second-stage compression unit (120). The front chamber (180) is provided around the cover member (171) and has an annular shape along the outer periphery of the cover member (171). The second passage (150) is connected to the front chamber (180).

Figure 4:
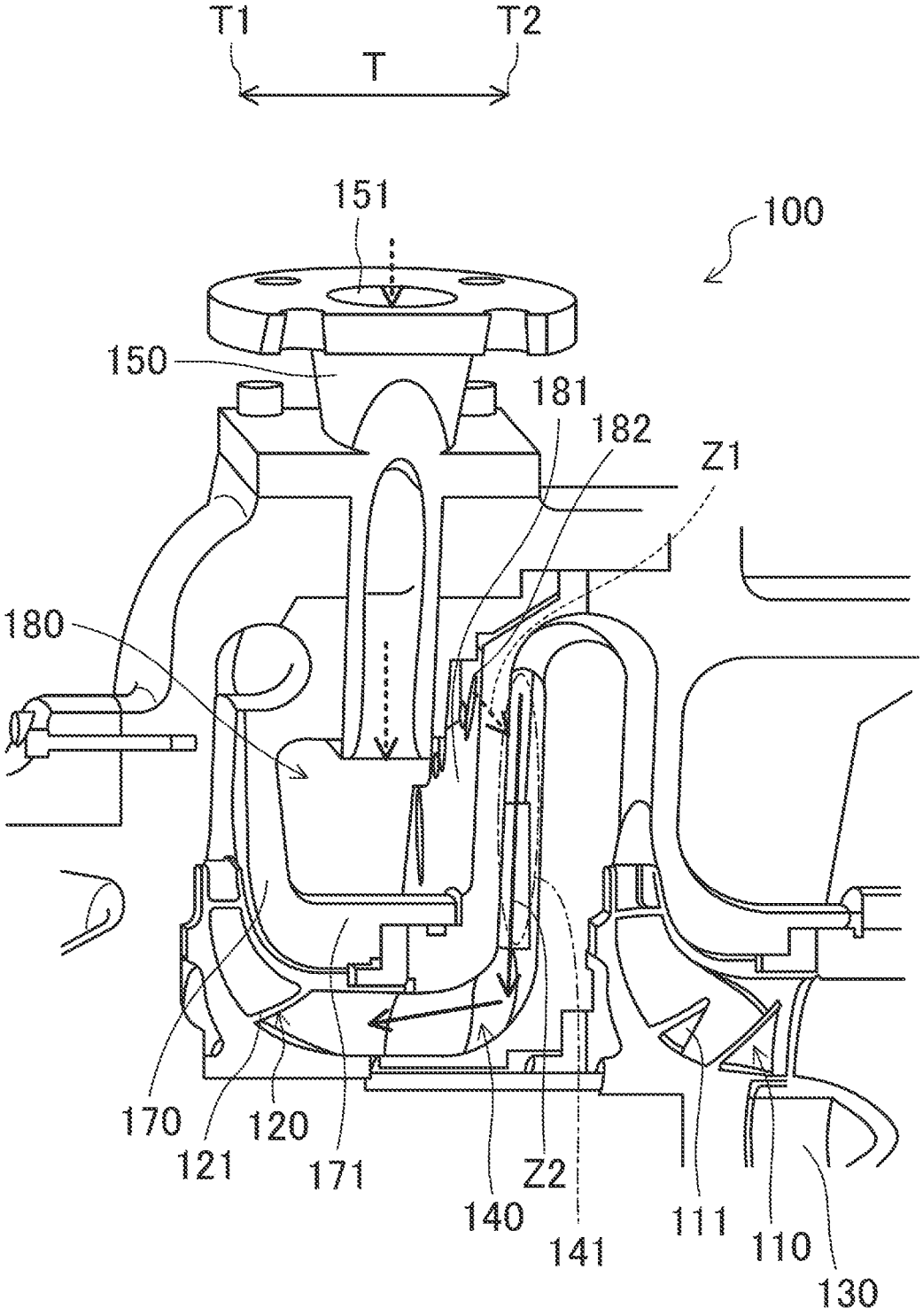
FIG. 4 is a IV-IV sectional view of the compressor illustrated in FIG. 3.
Figure 5:
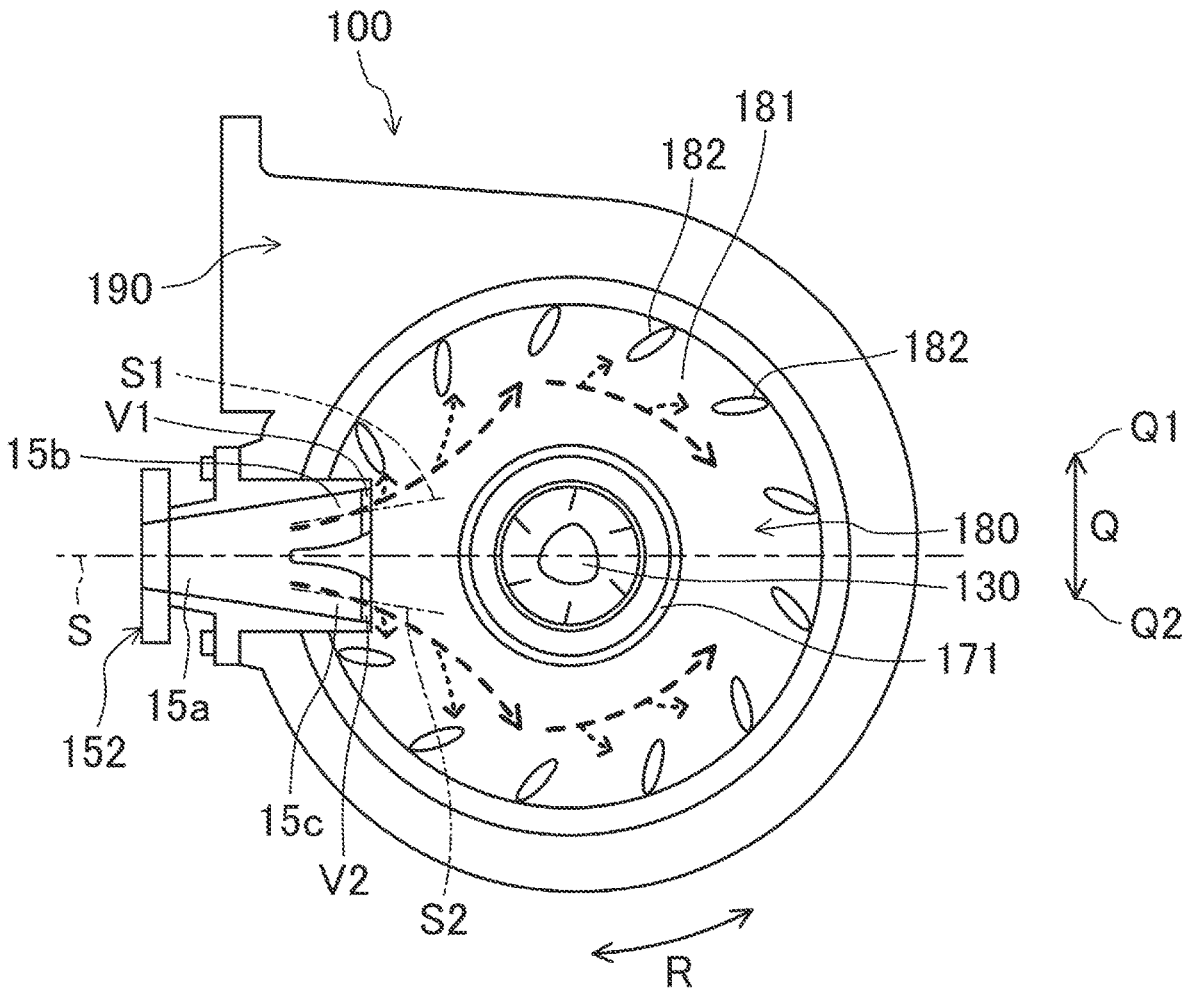
FIG. 5 is a V-V sectional view of the compressor illustrated in FIG. 3.

FIG. 5 is a view in which the front chamber (180) is viewed from the one direction side (T1) (refer to FIG. 3 and FIG. 4) in the axial direction (T) of the shaft member (130).

As illustrated in FIG. 4 and FIG. 5, the second passage (150) includes an opening portion (151) and a connection portion (152). The opening portion (151) is provided at one end of the second passage (150) and causes the inside and the outside of the second passage (150) to be in communication with each other. The opening portion (151) is connected to the economizer (400) (refer to FIG. 1). The connection portion (152) is provided at the other end of the second passage (150) and is connected to the front chamber (180).

The refrigerant from the economizer (400) flows into the second passage (150) through the opening portion (151) and is then supplied to the front chamber (180) from the connection portion (152).

The front chamber (180) includes a wall portion (181) and a plurality of suction ports (182).

The wall portion (181) covers another direction side (T2) of the front chamber (180) in the axial direction (T). The first passage (140) is present on the other direction side (T2) in the axial direction (T) with respect to the wall portion (181). The front chamber (180) and the first passage (140) are partitioned from each other by the wall portion (181).

Hereinafter, a portion of the first passage (140), the portion facing the wall portion (181) and being present on the other direction side (T2) in the axial direction (T) with respect to the front chamber (180), may be referred to as a merging portion (141).

The plurality of suction ports (182) are provided in the wall portion (181) and extend through the wall portion (181). The plurality of suction ports (182) are disposed at a location away from the cover member (171). The plurality of suction ports (182) are disposed side by side in a circumferential direction (R) of the shaft member (130).

The front chamber (180) is in communication with the merging portion (141) of the first passage (140) through the plurality of suction ports (182).

Figure 6:
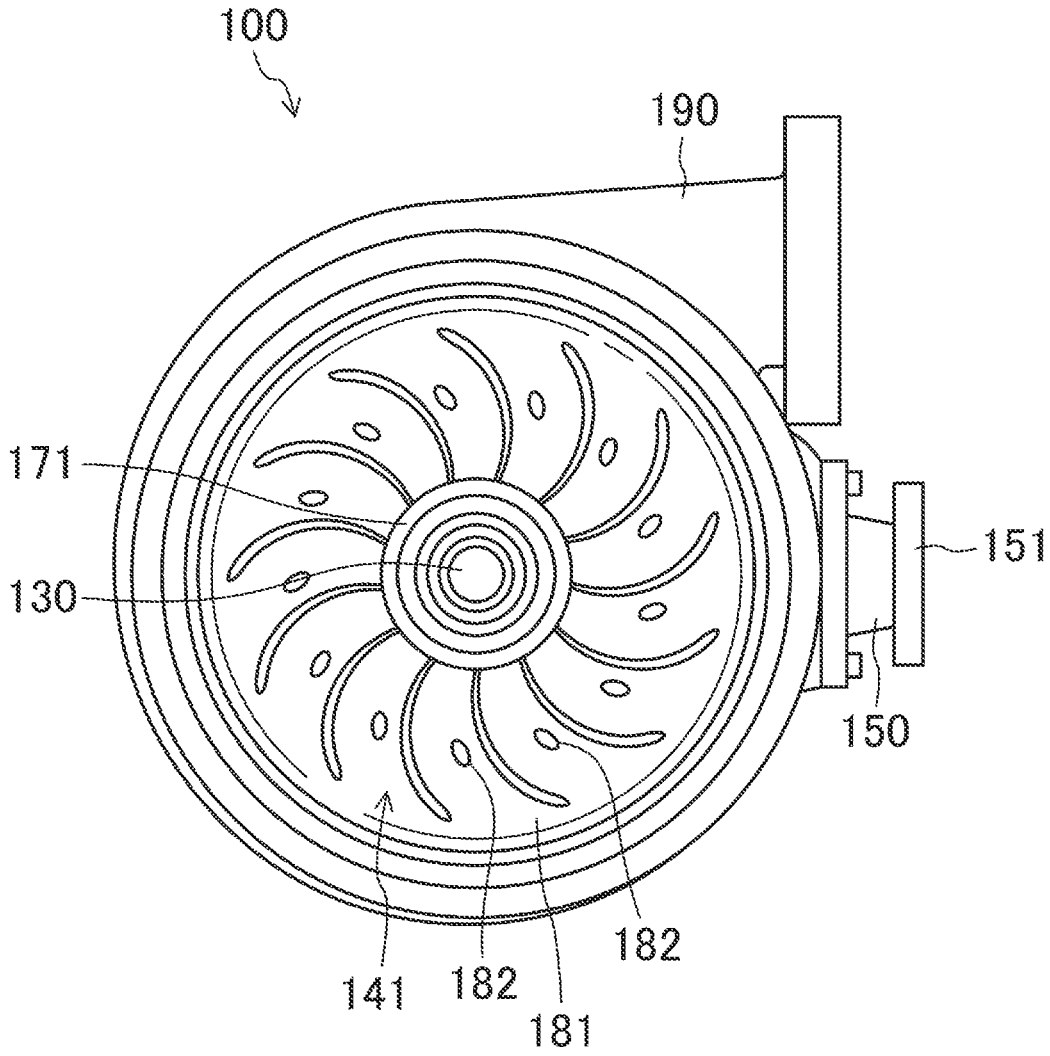
FIG. 6 is a VI-VI sectional view of the compressor illustrated in FIG. 3.
Figure 7:
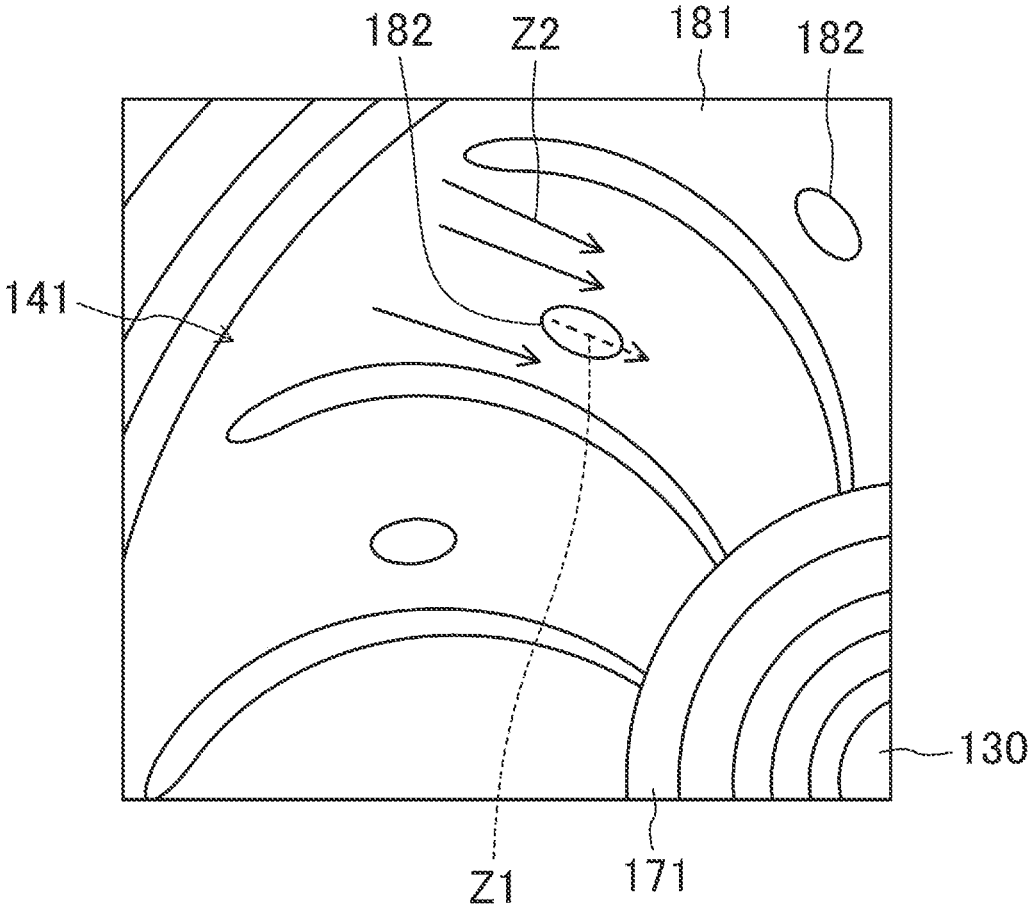
FIG. 7 is an enlarged view of a part of the sectional view illustrated in FIG. 6.

FIG. 6 is a view in which the merging portion (141) of the first passage (140) is viewed from the other direction side (T2) (refer to FIG. 3 and FIG. 4) in the axial direction (T) of the shaft member (130). FIG. 7 is an enlarged view of a part of FIG. 6. In FIG. 4 and FIG. 7, the arrows of solid lines indicate the flow of the refrigerant that flows from the first-stage compression unit (110) toward the second-stage compression unit (120). In FIG. 4, FIG. 5, and FIG. 7, the arrows of dotted lines indicate the flow of the refrigerant that flows from the economizer (400) (refer to FIG. 1) toward the merging portion (141) of the first passage (140) through the second passage (150), the front chamber (180), and the plurality of suction ports (182).

As illustrated in FIG. 4 to FIG. 7, the refrigerant supplied from the economizer (400) (refer to FIG. 1) to the front chamber (180) through the second passage (150) flows into the merging portion (141) of the first passage (140) through the plurality of suction ports (182). A refrigerant (Z1) that has flowed into the merging portion (141) of the first passage (140) merges with a main-stream refrigerant (Z2) that flows from the first-stage compression unit (110) toward the second-stage compression unit (120). As a result, the refrigerant (Z1) and the refrigerant (Z2) are sent to the second-stage compression unit (120).

The third passage (190) is connected to the second-stage compression unit (120). The first pipe (610) (refer to FIG. 1) is connected to the third passage (190).

The refrigerant (Z1) and the refrigerant (Z2) that are compressed by the second-stage compression unit (120) are sent to the condenser (300) through the third passage (190) and the first pipe (610) (refer to FIG. 1).

Connection Portion of Second Passage

With reference to FIG. 5, the configuration of the connection portion (152) at which the second passage (150) is connected to the front chamber (180) will be described.

As illustrated in FIG. 5, the shaft member (130) is present on an axis (S) of the connection portion (152) of the second passage (150). The axis (S) of the connection portion (152) is an imaginary line extending along the second passage (150) so as to pass through the center of the connection portion (152) of the second passage (150).

The connection portion (152) of the second passage (150) is bifurcated. As a result of the connection portion (152) being bifurcated, the refrigerant supplied from the connection portion (152) of the second passage (150) to the front chamber (180) flows along the axis (S) to the shaft member (130), and hitting of the refrigerant against the cover member (171) is suppressed. The bifurcated structure of the connection portion (152) is one example of the rectifying mechanism of the present invention.

The bifurcated structure of the connection portion (152) will be described in detail.

As illustrated in FIG. 5, the connection portion (152) includes a main flow portion (15*a*), a first branch flow portion (15*b*), and a second branch flow portion (15*c*). The main flow portion (15*a*) is connected to the opening portion (151) (refer to FIG. 3). The entirety of the refrigerant that has flowed into the second passage (150) through the opening portion (151) flows into the main flow portion (15*a*). The main flow portion (15*a*) has a shape in which the area of the passage increases toward the front chamber (180), which is on the downstream side.

The first branch flow portion (15*b*) and the second branch flow portion (15*c*) are connected to the downstream side of the main flow portion (15*a*). The main flow portion (15*a*) is branched into the first branch flow portion (15*b*) and the second branch flow portion (15*c*). Part of the refrigerant that flows in the main flow portion (15*a*) is sent to the first branch flow portion (15*b*). The other part of the refrigerant that flows in the main flow portion (15*a*) is sent to the second branch flow portion (15*c*). A downstream end portion of the first branch flow portion (15*b*) and a downstream end portion of the second branch flow portion (15*c*) have a discharge port (V1) and a discharge port (V2), respectively, for the refrigerant, and the refrigerant is supplied through the discharge ports (V1) and (V2) to the front chamber (180).

In FIG. 5, a perpendicular direction (Q) indicates a direction perpendicular to the axis (S) of the connection portion (152) and to the axial direction (T) (refer to FIG. 3) of the shaft member (130).

As illustrated in FIG. 5, an axis (S1) of the first branch flow portion (15*b*) is inclined at an acute angle toward one direction side (Q1) in the perpendicular direction (Q) with respect to the axis (S) of the connection portion (152). The axis (S1) of the first branch flow portion (15*b*) is an imaginary line extending along the first branch flow portion (15*b*) so as to pass through the center of the first branch flow portion (15*b*).

The axis (S2) of the second branch flow portion (15*c*) is inclined at an acute angle toward another direction side (Q2) in the perpendicular direction (Q) with respect to the axis (S)

of the connection portion (152). The axis (S2) of the second branch flow portion (15*c*) is an imaginary line extending along the second branch flow portion (15*c*) so as to pass through the center of the second branch flow portion (15*c*).

Effects of Embodiment

As described above, the second passage (150) is provided with a passage structure configured such that the flow direction of the refrigerant supplied to the front chamber (180) through the second passage (150) is an avoidance direction that is a direction different from the direction toward the shaft member (130). Consequently, it is possible to suppress occurrence of a situation in which the refrigerant supplied through the second passage (150) to the front chamber (180) hits against the cover member (171) and causes a pressure loss of the refrigerant. As a result, it is possible to suppress generation of unevenness in the refrigerant from the front chamber (180) when the refrigerant from the front chamber (180) mixes with the refrigerant that is sent from the first-stage compression unit (110) to the second-stage compression unit (120) in the merging portion (141) of the first passage (140).

In addition, as a result of the axis (S1) of the first branch flow portion (15*b*) and the axis (S2) of the second branch flow portion (15*c*) being inclined toward the sides opposite to each other with respect to the axis (S) of the connection portion (152) to form the bifurcated structure of the connection portion (152) of the second passage (150), it is possible to suppress occurrence of a situation in which the refrigerant from the first branch flow portion (15*b*) and the second branch flow portion (15*c*) hits against the cover member (171) and causes a pressure loss of the refrigerant. As a result, due to the bifurcated structure of the second passage (150), it is possible to cause the refrigerant supplied through the second passage (150) to the front chamber (180) to flow effectively to the periphery of the cover member (171) and, as a result, possible to effectively supply the refrigerant to the merging portion (141) of the first passage (140) through the plurality of suction ports (182).

The second passage (150) includes a portion (main flow portion (15*a*)) in which the area of the passage increases toward the front chamber (180). Consequently, it is possible to cause the refrigerant to flow effectively in the second passage (150) so as to spread to be forked into two.

First Modification of Connection Portion

Figure 8:
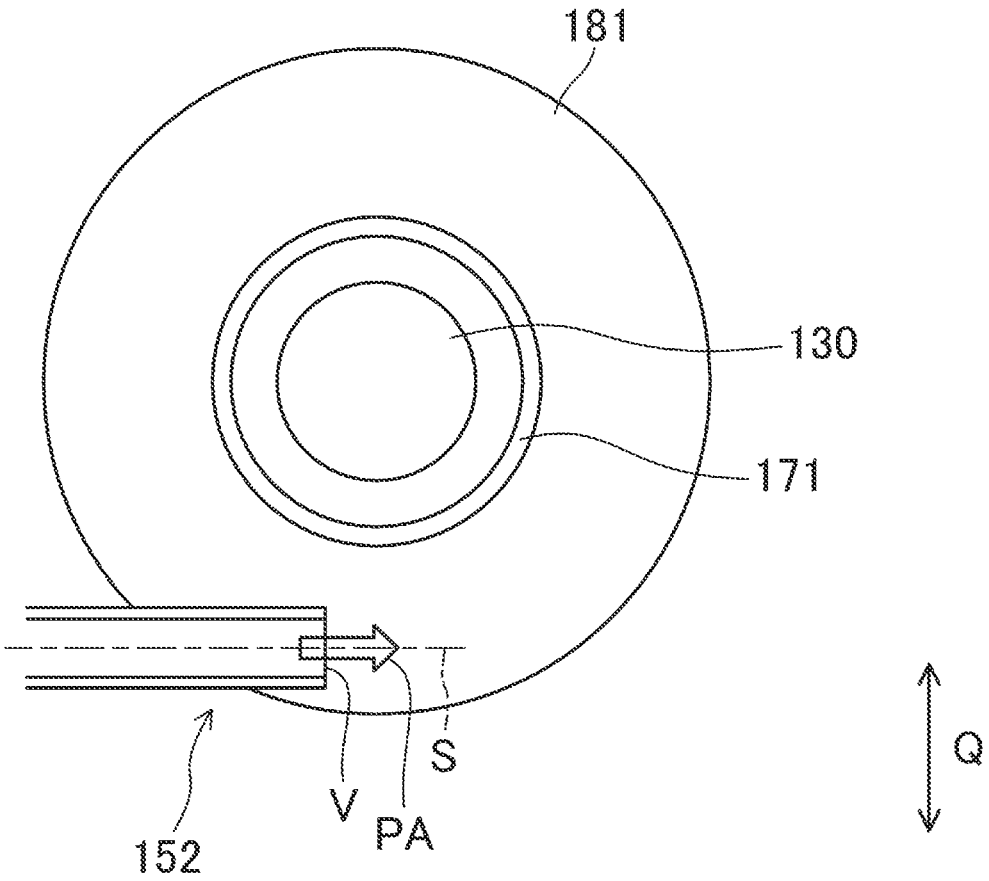
FIG. 8 is a schematic view of a first modification of a connection portion of a second passage.

With reference to FIG. 8, a first modification of the connection portion (152) will be described. FIG. 8 is a schematic view of the first modification of the connection portion (152).

As illustrated in FIG. 8, the connection portion (152) in the first modification is constituted by one passage without being bifurcated, and the connection portion (152) thus has one discharge port (V) for the refrigerant. In addition, in the first modification, the connection portion (152) is disposed at a location shifted parallel in the perpendicular direction (Q) compared with that in the embodiment illustrated in FIG. 5, and the passage structure of the second passage (150) is configured such that the axis (S) of the connection portion (152) does not intersect the cover member (171). As a result, hitting of the refrigerant (PA) from the discharge port (V) of the connection portion (152) against the cover member (171) can be suppressed.

Second Modification of Connection Portion

Figure 9:
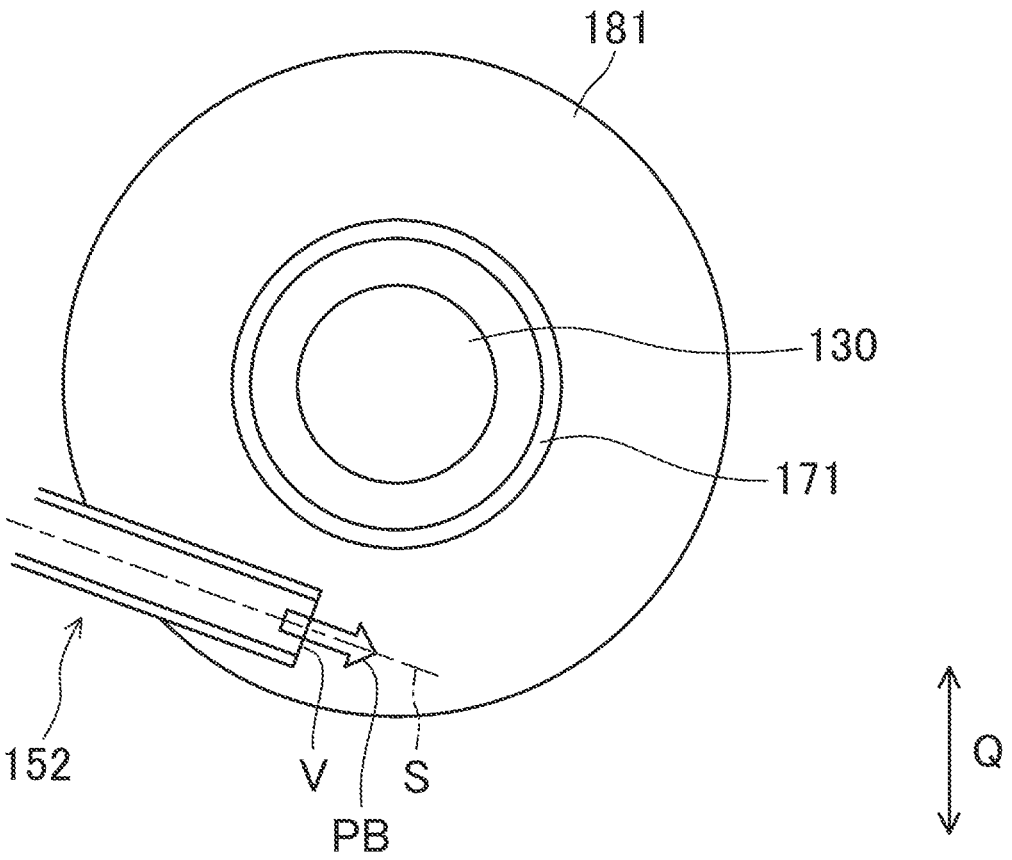
FIG. 9 is a schematic view of a second modification of a connection portion of a second passage.

With reference to FIG. 9, a second modification of the connection portion (152) will be described. FIG. 9 is a schematic view of the second modification of the connection portion (152).

As illustrated in FIG. 9, the connection portion (152) in the second modification is constituted by one passage without being bifurcated, and the connection portion (152) thus has one discharge port (V) for the refrigerant. In addition, in the second modification, the connection portion (152) is disposed such that the axis (S) of the connection portion (152) is inclined compared with that in the embodiment illustrated in FIG. 5, and the passage structure of the second passage (150) is thus configured such that the axis (S) of the connection portion (152) does not intersect the cover member (171). As a result, hitting of the refrigerant (PB) flowing from the discharge port (V) of the connection portion (152) against the cover member (171) can be suppressed.

Other Embodiments

While an embodiment and modifications have been described above, it should be understood that various changes in forms and details are possible without deviating from the gist and the scope of the claims. Further, the embodiment and the modifications described above may be combined together or replaced, as appropriate, as long as intended functions of the present disclosure are maintained.

As described above, the present disclosure is useful for a compressor.

The invention claimed is:

1. A compressor comprising:

a first-stage compression unit configured to compress a refrigerant;

a second-stage compression unit configured to compress the refrigerant compressed by the first-stage compression unit;

a shaft member connected to the first-stage compression unit and the second-stage compression unit; and a cover member configured to cover the shaft member, a first passage being provided between the first-stage compression unit and the second-stage compression unit, a front chamber being provided around the cover member, the front chamber being connected to the first passage and to a second passage to which the refrigerant from an economizer is sent, and the second passage being provided with a passage structure configured such that a flowing direction of the refrigerant supplied through the second passage to the front chamber is an avoidance direction, the avoidance direction being a direction that differs from a direction toward the shaft member, the second passage having a first discharge port and a second discharge port, the axes of each of the first and second discharge ports defining an acute angle with regard to a longitudinal axis of the second passage, a first branch flow portion of the second passage being provided with the first discharge port, a second branch flow portion of the second passage being provided with the second discharge port, a first distance between a first inner wall of the first branch flow portion closest to the longitudinal axis and the longitudinal axis increasing toward the first discharge port, and a second distance between a second inner wall of the second branch flow portion closest to the longitudinal axis and the longitudinal axis increasing toward the second discharge port.

2. The compressor according to claim 1, wherein the shaft member is disposed on an axis of a connection portion of the second passage, the connection portion being connected to the front chamber.

3. The compressor according to claim 1, wherein the second passage includes a portion in which an area of the passage increases toward the front chamber.

4. The compressor according to claim 1, wherein the front chamber has a suction port that is in communication with the first passage, and the suction port is disposed at a location spaced from the cover member.

5. The compressor according to claim 2, wherein the front chamber has a suction port that is in communication with the first passage, and the suction port is disposed at a location spaced from the cover member.

6. The compressor according to claim 1, wherein the front chamber has a suction port that is in communication with the first passage, and the suction port is disposed at a location spaced from the cover member.

7. The compressor according to claim 3, wherein the front chamber has a suction port that is in communication with the first passage, and the suction port is disposed at a location spaced from the cover member.

8. The compressor according to claim 4, wherein a plurality of the suction ports are provided side by side in a circumferential direction of the shaft member.

9. The compressor according to claim 5, wherein a plurality of the suction ports are provided side by side in a circumferential direction of the shaft member.

10. The compressor according to claim 6, wherein a plurality of the suction ports are provided side by side in a circumferential direction of the shaft member.

11. The compressor according to claim 7, wherein a plurality of the suction ports are provided side by side in a circumferential direction of the shaft member.

* * * * *